US007694872B2

(12) United States Patent
Noll et al.

(10) Patent No.: US 7,694,872 B2
(45) Date of Patent: Apr. 13, 2010

(54) CASHBOX AND APPARATUS FOR EMPTYING THE CASHBOX

(75) Inventors: Elmar Noll, Mönchengladbach (DE); Bernd Voeller, Mönchengladbach (DE)

(73) Assignee: Scheidt & Bachmann, GmbH (DE)

( * ) Notice: Subject to any disclaimer, the term of this patent is extended or adjusted under 35 U.S.C. 154(b) by 715 days.

(21) Appl. No.: 10/195,220

(22) Filed: Jul. 15, 2002

(65) Prior Publication Data

US 2004/0007615 A1 Jan. 15, 2004

(51) Int. Cl.
*G07B 15/00* (2006.01)

(52) U.S. Cl. ..... 232/15; 232/16; 232/1 D; 109/47; 194/350

(58) Field of Classification Search ..... 232/15, 232/16, 31, 32, 1 D, 43.1, 43.5, 4 R, 12; 194/350; 109/24.1, 47; 220/345.1, 345.2
See application file for complete search history.

(56) References Cited

U.S. PATENT DOCUMENTS 1,840,561 A * 1/1932 Miller ..... 220/810
2,524,907 A * 10/1950 Harris ..... 232/15
2,543,751 A * 3/1951 Atkinson ..... 232/1 D
2,580,752 A * 1/1952 Forester ..... 232/15
3,120,235 A * 2/1964 Ferrell ..... 453/62
3,292,849 A * 12/1966 Ewing ..... 232/43.2
3,433,185 A * 3/1969 Roberts ..... 109/55
3,741,464 A * 6/1973 Verbeke ..... 232/15
3,773,252 A * 11/1973 Jensen ..... 232/1 R
4,286,526 A * 9/1981 Rabelos ..... 109/73
4,452,390 A * 6/1984 West ..... 232/4 R
4,493,454 A * 1/1985 Giebelhausen et al. ..... 232/15
4,638,746 A * 1/1987 Ishigure ..... 109/52
4,648,327 A 3/1987 Toth et al.
4,655,391 A * 4/1987 Granzow et al. ..... 232/43.1
6,059,090 A 5/2000 Davis et al.
6,490,893 B1 * 12/2002 Benion ..... 70/63

FOREIGN PATENT DOCUMENTS

DE 3337829 8/1984
FR 2639671 6/1990
FR 2698907 6/1994

* cited by examiner

*Primary Examiner*—William L. Miller
(74) *Attorney, Agent, or Firm*—Cantor Colburn LLP

(57) ABSTRACT

An apparatus for emptying a cashbox, fare-box or the like, wherein the apparatus includes a right-parallelepiped-shaped casing and a cashbox including at least one slidable wall, wherein the casing has a container for inserting the cashbox so that this is positioned with the slidable wall facing downwards on a slider located in the casing of the apparatus, wherein the slider includes: a handle, a connecting apparatus for connection with the wall of the cashbox, and a blocking apparatus which allows the slider to be withdrawn from the casing into a withdrawn end position and then pushed in into a fully inserted end position but prevents any pushing in of the slider from any withdrawn position which does not correspond to the end position.

17 Claims, 7 Drawing Sheets

CASHBOX AND APPARATUS FOR EMPTYING THE CASHBOX

FIELD OF THE INVENTION

The present invention relates to an apparatus for emptying a cashbox, fare-box, or the like, as well as a cashbox with the apparatus according to the invention.

DESCRIPTION OF THE RELATED ART

In economic exchange there are known a plurality of payment systems, especially automatic machines, with which a customer can obtain goods and/or services against payment by cash, vouchers and the like. The automatic machine accepts the means of payment, checks its value and validity and transfers a means of payment found to be valid to a storage device where this means of payment is stored. Such payment systems are also used on many occasions for the sale of tickets, for example, for passenger conveyance means and the like.

The money storage device is usually emptied during maintenance. According to the prior art, it is known that the automatic machine has a lockable opening through which the means-of-payment container can be removed or exchanged when in the open state. The containers are closed when outside the automatic machine in order to avoid any loss of means of payment or to prevent unauthorised access. In order to empty the containers, these generally have an opening on the upper side through which the contents can be removed. For removal the container is tipped for example.

As well as handling a generally cumbersome and heavy container, a disadvantage is that they have to be tipped for emptying.

SUMMARY OF THE INVENTION

The object of the present invention is thus to provide an apparatus by means of which the means of payment can be simply and securely removed while avoiding the handling of individual containers.

As a solution, an apparatus for emptying a cashbox, fare-box or the like is proposed according to the invention wherein the apparatus essentially consists of a right-parallelepiped-shaped casing and the cashbox comprises at least one slidable wall, wherein the casing has a container for inserting a cashbox so that this is positioned with the slidable wall facing downwards on a slider located in the casing of the apparatus, wherein the slider comprises: a handle, a connecting apparatus for connection with the wall of the cashbox, and a blocking apparatus which allows the slider to be withdrawn from the casing into a withdrawn end position and then pushed in into a fully inserted end position but prevents any pushing in of the slider from any withdrawn position which does not correspond to the end position.

With the development according to the invention, the removal of large quantities of means of payment can be made easier while simultaneously facilitating easy handling. Exchange and transportation of cumbersome containers can be avoided. Nevertheless, the secure and complete emptying can be ensured by the development according to the invention. Thus, for example, the slidable wall can be guided such that means of payment are stripped from a surface of the wall on the inner-area side by the opening movement in order to ensure complete emptying. Among other things, this is assisted by the fact that the slider can only be moved back into the completely inserted end position after attaining the completely withdrawn end position. For example, the wall can form the bottom of the cashbox. By withdrawing the wall sideways, an opening is formed through which the stored means of payment can fall into a collecting container positioned thereunder.

It is further proposed that the handle can be pivoted between a folded-in and a folded-out position towards the casing. Thus it is advantageous if a locking state of the wall can be indicated by the position of the handle. The locking state can thus be determined by an operator without further means and without any power supply. Furthermore, an ergonomically favourable position for the operator can be achieved by means of the pivotable handle. The handle can also be positioned in a protected position if the wall is locked in the fully inserted end position, for example, in order to avoid damage caused by surrounding operating sequences.

For this purpose it is also proposed that the handle is a grip. Advantageously single-handed operation can be achieved.

In a further refinement according to the invention, it is proposed that the connecting apparatus comprises at least one locking element which is insertable in a groove in the slidable wall of the cashbox. Advantageously it can be achieved that the wall is unlocked in the fully inserted end position by the slider so that the wall is fixed as a constituent of the cashbox.

For this purpose it is also proposed that the slider has a mechanism via which the connecting apparatus makes a connection between the slider and the slidable wall of the cashbox when the handle is folded out. Thus, it can advantageously be achieved that the connection is only made if the handle is pivoted by an operator into a folded-out position. In the folded-in position of the handle the slider can be moved without taking the wall with it. It can be achieved that the wall is only slidable if the operator is in the immediate vicinity of the cashbox. For example, the handle can be pre-tensioned by a spring force in the folded-in position so that when the operator moves away, the unlocking is automatically re-made.

According to a further development of the present invention, it is proposed that the blocking apparatus comprises a blocking member which is guided along a ratchet. Thus, it can be achieved that the wall provided with the slider can only be moved back into the fully inserted end position after attaining the fully withdrawn end position. In this way, it can be avoided that means of payment residue remain on the surface of the wall on the side of the storage device, which assists complete emptying of the cashbox. For example, the ratchet can be constructed as a sawtooth-shaped section on the slider, where there is provided a lever which interacts with the ratchet in the direction of the ratchet.

In an advantageous further development of the present invention, it is proposed that the blocking member is switchable between a position which allows insertion of the slider and a position which impedes insertion. It can be achieved that the slider is re-insertable by means of a suitable action, where the action takes place by switching over the blocking member. Advantageously, an uncontrolled forward and backward movement of the slider can be avoided.

It is also proposed that the blocking member is respectively switchable into the inserted and withdrawn end position of the slider. Thus, a position of the blocking member in which it is not engaged with the ratchet can advantageously be made regressive so that the blocking member re-engages with the ratchet. It can be achieved that a renewed insertion can only be executed when the fully withdrawn end position has been reached by the slider. It can further be achieved that during withdrawal from the inserted end position the blocking member interacts with the ratchet and thus prevents re-insertion of the slider before reaching the fully withdrawn end position. Only after reaching the fully withdrawn end position can the blocking member be switched over to a position not connected to the ratchet so that the insertion of the slider is released. For this purpose, for example, on attaining the fully withdrawn end position, the blocking member can be held mechanically in a position in which it no longer engages with the ratchet so that re-insertion is made possible.

In a further development it is proposed that the blocking member is spring-loaded. Thus, for example, the blocking member can be pre-tensioned against the ratchet by a spiral or leaf spring in order to achieve the desired function.

It is further proposed that the blocking member should be located on the casing and the ratchet on the slider. It can thus be advantageously achieved that the movement of the slider simultaneously brings about a movement of the ratchet where the blocking member located in a fixed position relative to the slider engages with the ratchet and thus the desired function is achieved.

The invention also proposes a cashbox consisting of a casing which comprises a lid, four side walls and a bottom wall, where the lid has a slit-like opening and where at least one of the walls is displaceable relative to the casing. It can thus advantageously be achieved that a supply of replaceable containers is reduced. The cashbox can be completely and reliably emptied by displacing the at least one wall. Means for handling the exchange containers and storage costs can be saved or reduced.

In a further development it is proposed that the wall has at least one groove to accommodate a locking element. Advantageously the slidable wall can be connected to a slider in order to empty the contents of the cashbox through an opening produced by sliding the slidable wall. For example, the locking element can be formed by a pin drivable via a mechanism.

It is further proposed that the groove is constructed on the outside of the wall and is closed towards the inside of the wall. Thus, on the one hand, it can be achieved that the inside of the wall forms a uniform closed surface on which no means of payment can settle. The arrangement of the groove in the outward-directed surface of the wall also, on the other hand, advantageously makes it possible for the locking element to engage outside the means-of-payment area of the cashbox so that engagement cannot be hindered, for example, by means of payment which may lie in the path.

In an advantageous further development of the present invention it is proposed that this has a security apparatus for securing the slidable wall against displacement. It can be achieved that the wall is securable against unauthorised displacement so that, for example, only an authorised person can have access. For example, the security apparatus can be controlled by a remote control system where authorisation of an operator is checked before releasing the safety device.

It is further proposed that the safety device is unlockable. Thus, for example, the safety device is unlockable by means of a lock which can only be operated by authorised persons. The lock can be constructed as a mechanical lock or as an electronic lock. However, it can also be provided that a release signal is additionally required from a remote control system to enable the operator to unlock the safety device.

In a further development of the present invention, it is proposed that this has an apparatus for blocking the slit-like opening against intervention inside the casing and to prevent return of objects inserted through the slit in the casing into the area of the casing located beneath the slit. Thus, for example, it can be prevented that means of payment are removed from the inner area of the cashbox without authorisation. The apparatus can be formed, for example, by a lockable flap or the like.

It is further proposed that the slidable wall is inclined with respect to the horizontal. Thus, for example, the force expenditure required to slide the wall can be reduced. It can further be achieved that as a result of the weight of the wall, a force is exerted in the direction of closure which promotes movement of the wall into the fully inserted position.

Further advantages and features can be obtained from the following descriptions of examples of embodiment with reference to the relevant drawings. Substantially the same components are denoted by the same reference symbols. In addition, with reference to the same features and functions reference is made to the description for the example of embodiment in FIG. 1. The drawings are schematic and serve only to explain the following example of embodiment.

DETAILED DESCRIPTION

Figure 1:
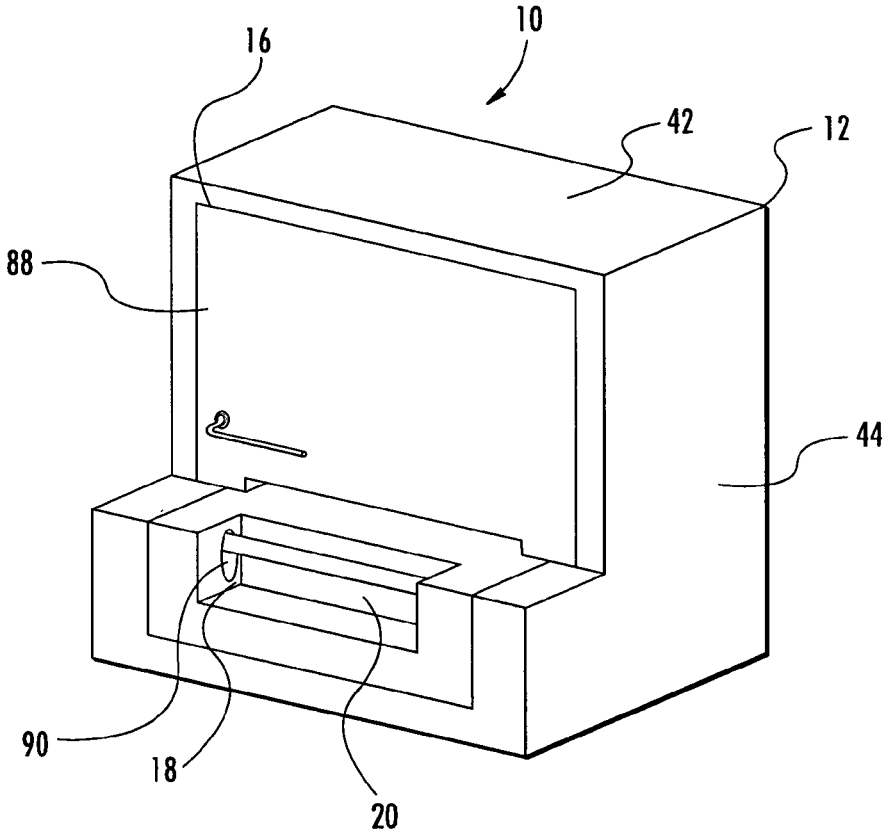
FIG. 1 is a perspective, schematic view of an emptying apparatus according to the invention with a cashbox located therein.
Figure 2:
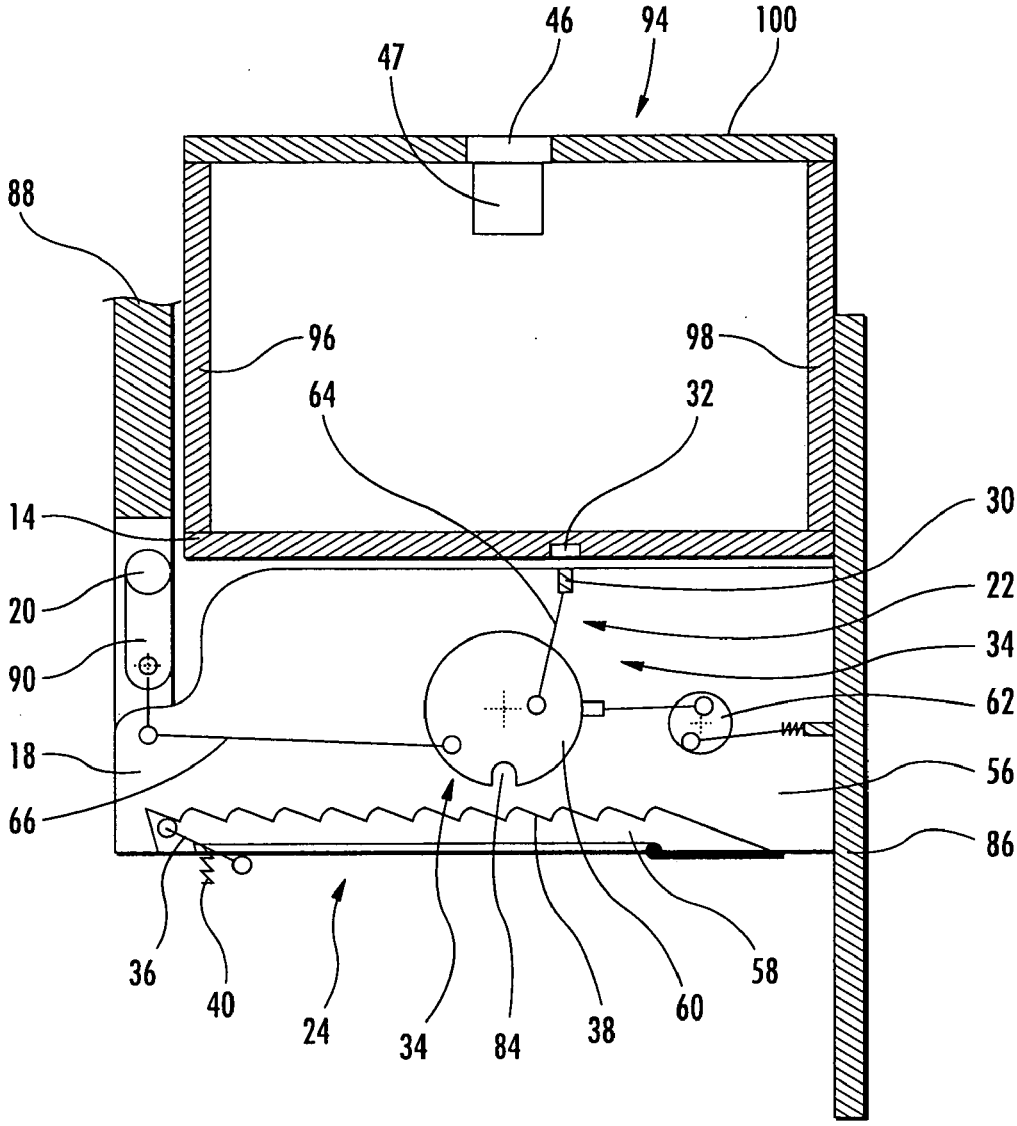
FIG. 2 is a section through the emptying apparatus in FIG. 1 where the slider and the slidable wall of the cashbox are disconnected.

FIG. 1 shows an apparatus 10 according to the invention for emptying a cashbox 94, wherein the apparatus 10 consists of a substantially right-parallelepiped-shaped casing 12. The casing 12 has a container 16 closable by means of a door 88 for inserting a cashbox 94 with a slidable wall 14 as well as side walls 96, 98, so that this is positioned on a slider 18 (FIG. 2) located in the casing 12 of the apparatus 10 with the slidable wall 14 directed downwards, wherein the slider 18 comprises: a handle 20, a connecting apparatus 22 for connection with the wall 14 of the cashbox 94 and a blocking apparatus 24, which allows the slider 18 to be withdrawn from the casing 12 into a withdrawn end position 26 and subsequent insertion into a fully inserted end position 28 but prevents any insertion of the slider 18 from any withdrawn position which does not correspond to the end position 26 (FIG. 2). In this refinement the handle 20 is formed by a grip which can be pivoted between a folded-in position relative to the casing 12 and a folded-out position. For this purpose the grip 20 has both its ends connected to an end region of a lever 90 wherein the lever 90 is rotatably supported at its opposite end regions. One of the levers 90 is additionally connected to a drive rod 66 wherein a pivoting movement of the lever 90 causes a pushing and/or pulling movement of the drive rod 66. The slider 18 is supported horizontally displaceably relative to the casing 12. It has a locking apparatus 22 which comprises a locking element 30 which can be inserted into a groove 32 of the slidable wall 14 of the cashbox 94. The lid 100 of the cashbox 94 further includes an opening or slot 46 formed therethrough for allowing insertion into the cashbox 94 of money or other items. The cash box 94 also includes an apparatus 47 for blocking the slot 46 against intervention inside the box 94 and for preventing return through the slot 46 of items inserted into the box 94.

The slider 18 also has a mechanism 34 with two cam disks 60, 62 and movable rods 64, 66, 68, 70. The mechanism 34 is driven via the handle 20. This is connected to the end of a rod 66 which at the other end is rotatably connected to the disk 60 in a radially off-centre fashion. Actuating the handle 20 thus leads to a corresponding rotatory movement of the disk 60. To drive the locking apparatus 22, the mechanism 34 has another movable rod 64 which is rotatably supported at one end on the disk 60 also in an off-centre fashion and its other end is actively connected to the locking element 30. A rotating movement of the disk 60 is converted into a push/pull movement of the moveable rod 64 and the locking element 30 connected to this. Thus, a pivoting movement of the handle 20 is converted into a transverse movement of the locking element 30.

In the fully inserted position 28 of the wall 14 of the cashbox 94 shown in FIG. 2 the slider 18 is disconnected from the wall 14 as a result of the position of the handle 20 and the thus predetermined position of the locking element 30.

Figure 3:
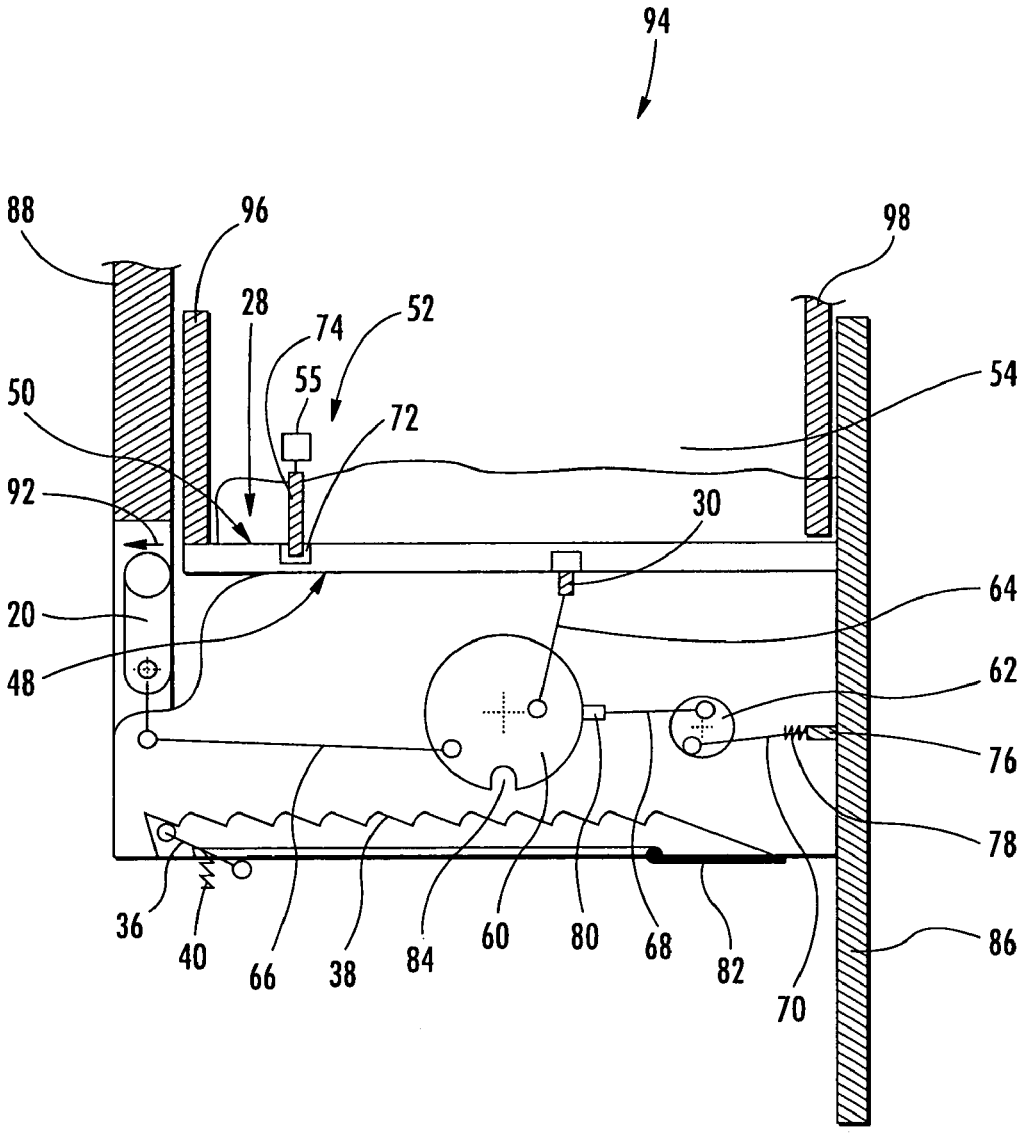
FIG. 3 is a section through the emptying apparatus in FIG. 1 where a security apparatus is additionally provided.

As shown in FIG. 3, the wall 14 is additionally secured by a security apparatus 52 against unintentional displacement in the opening direction 92. For this purpose the wall 14 has a groove 72 on the interior surface 50, in which a safety bolt 74 of the security apparatus 52 engages. The safety bolt 74 can be formed, for example, by a bolt formed by a lock 55. Here it is a constituent of a closing mechanism not shown in greater detail via which the wall 14 is connected to the cashbox 94 in a releasable fashion.

The mechanism 34 also has a second disk 62 which for its part is connected to the ends of the movable rods 68, 70, which are eccentrically rotatably supported on the disk 62. At its other end the rod 68 has a locking element 80 which runs on the circumference of the disk 60. At its other end the second rod 70 is connected to a displaceably supported plunger 76 which is pre-tensioned by the spring 78 in the direction of the casing rear wall 86 and abuts onto this (FIG. 2, FIG. 3).

Moreover, the slider 18 has a fairly long opening 58 in a side wall 56 which is provided with a ratchet 38 on its upper side. In the longitudinal direction the opening 58 extends into the edge region of the slider 18. At the end of the opening 58 opposite the end on the handle side, there is provided a leaf spring 82 which closes the opening 58. At the end on the handle side the opening 58 is open to the outside. On the casing 12 there is provided a pivoting blocking lever 36 which is pre-tensioned via a spring 40 in the direction of the ratchet 38. In the position shown in FIGS. 2 and 3 the lever 36 is pre-tensioned by the spring 40 in the direction of the ratchet 38 of the opening 58 so that this connects the ratchet 38.

Figure 4:
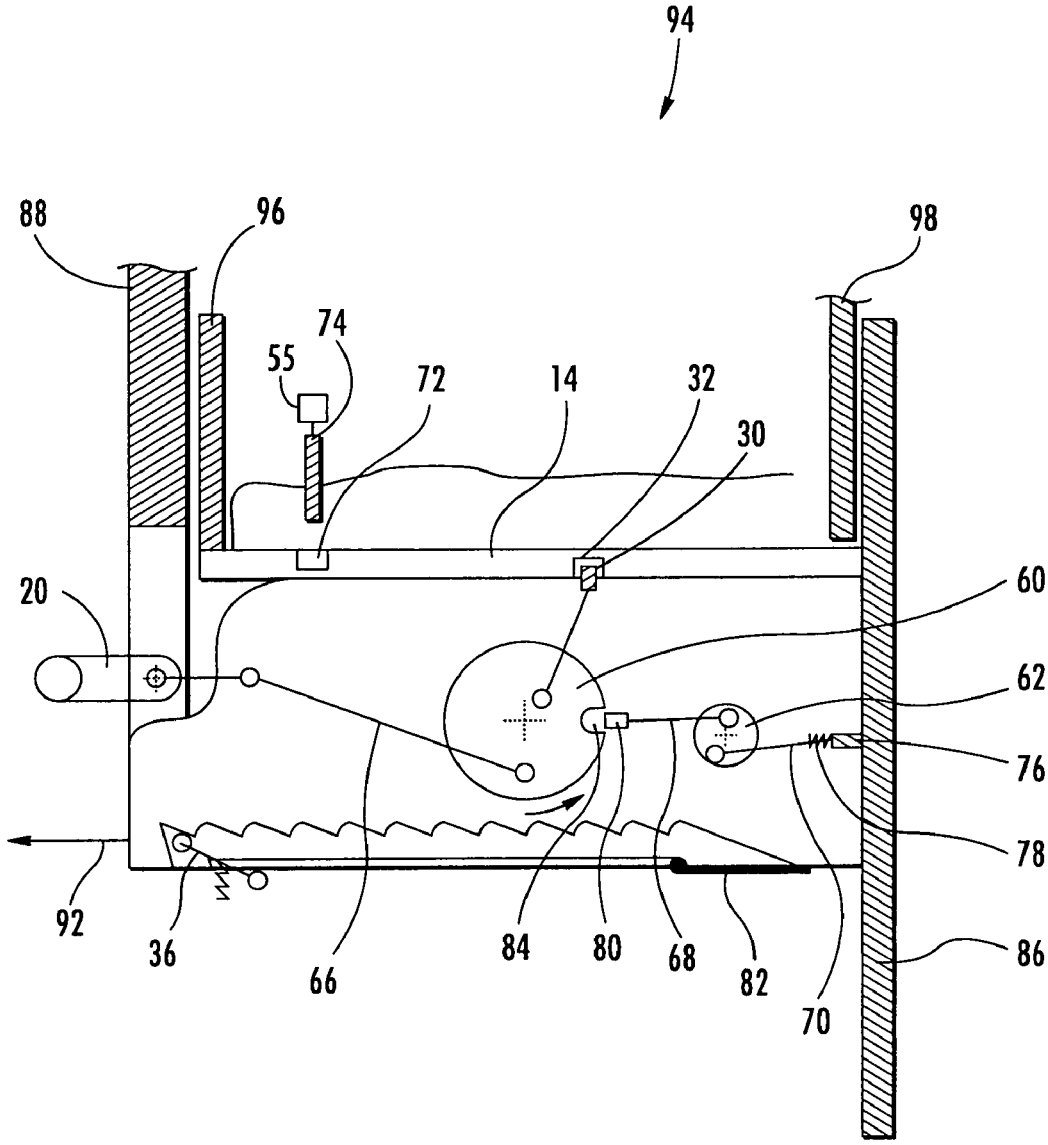
FIG. 4 is a section through the emptying apparatus in FIG. 3 where the wall of the cashbox is released and connected to the slider.

In order to withdraw the wall 14 together with the slider 18, the safety lock 74 is first moved out of the groove 72 by means of the lock in 55 so that the wall 14 is disconnected from the safety lock 74 (FIG. 4). By pivoting the handle 20 into the folded-out position, the disk 60 is turned anticlockwise by the rod 66 so that on the one hand, the locking element 30 is moved into the groove 32 by the rod 64 so that the wall 14 is now connected to the slider 18 and, on the other hand, a notch 84 provided in the disk 60 lies directly opposite the locking element 80.

Figure 5:
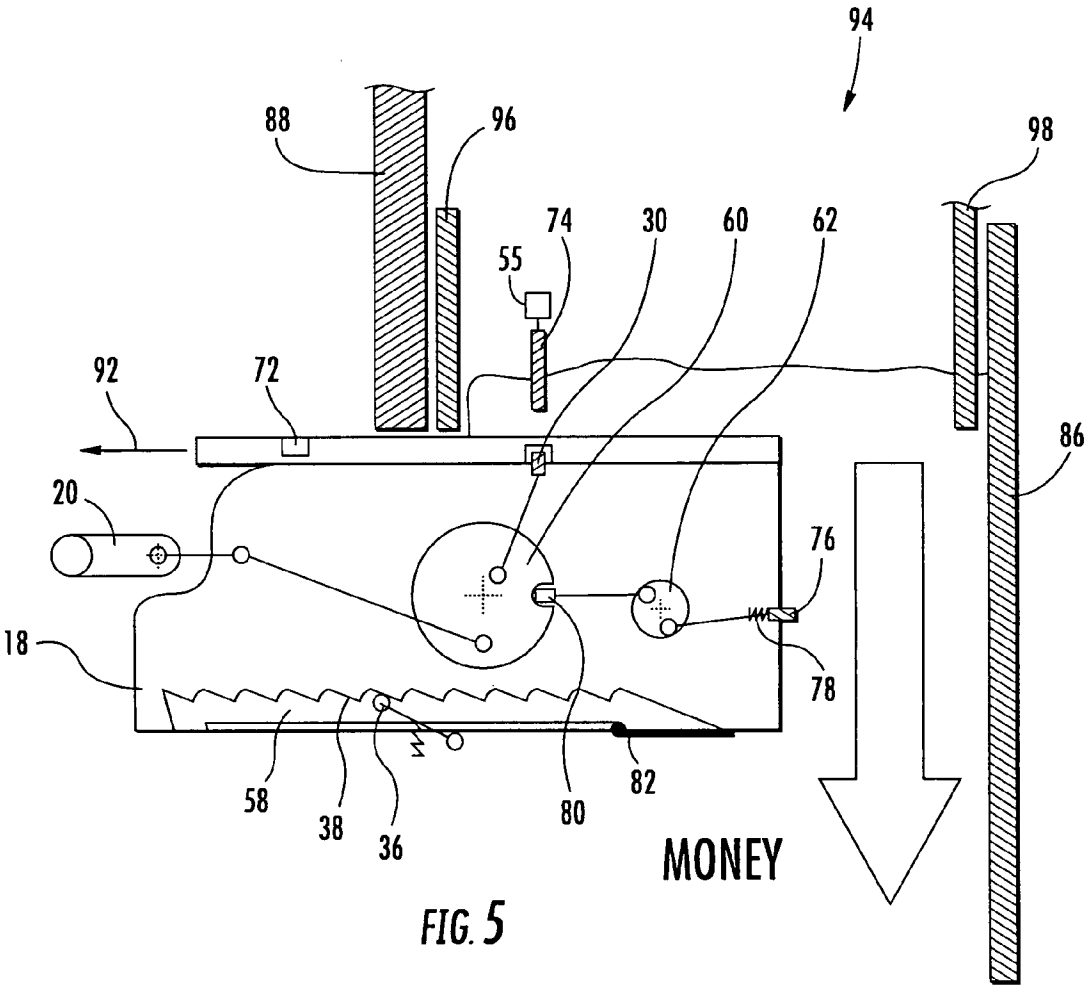
FIG. 5 is a sectional view of the emptying apparatus as in FIG. 3 where the wall of the cashbox is partly positioned in the opening direction by means of the slider of the emptying apparatus.

By pulling on the handle 20 the slider 18 is now moved together with the wall 14 in the opening direction 92 wherein the plunger 76 pre-tensioned by the spring 78 is moved in the direction of the wall 86 of the casing 12. This movement is transferred to a correspondingly opposed movement of the locking element 80 via the rod 70, the disk 62 and the rod 68 so that this element is inserted into the notch 84 of the disk 60. In this way the disk 60 is secured against further twisting so that the coupling of the slider 18 with the wall 14 and also the pivot position of the handle 20 are fixed (FIG. 5).

As the slider 18 moves in the opening direction 92, the ratchet 38 is simultaneously moved along via the blocking lever 36. As a result of its pre-stressing by the spring 40, the blocking lever 36 follows the curve profile of the ratchet 38. The curve profile of the ratchet 38 is selected so that once the blocking lever 36 has passed once over a ratchet tooth in one direction, it cannot pass over it in the opposite direction. The blocking lever 36 can thus only move back to the preceding ratchet tooth at the very most. Insertion of the slider 18 from a merely partly withdrawn position is thus avoided.

Figure 6:
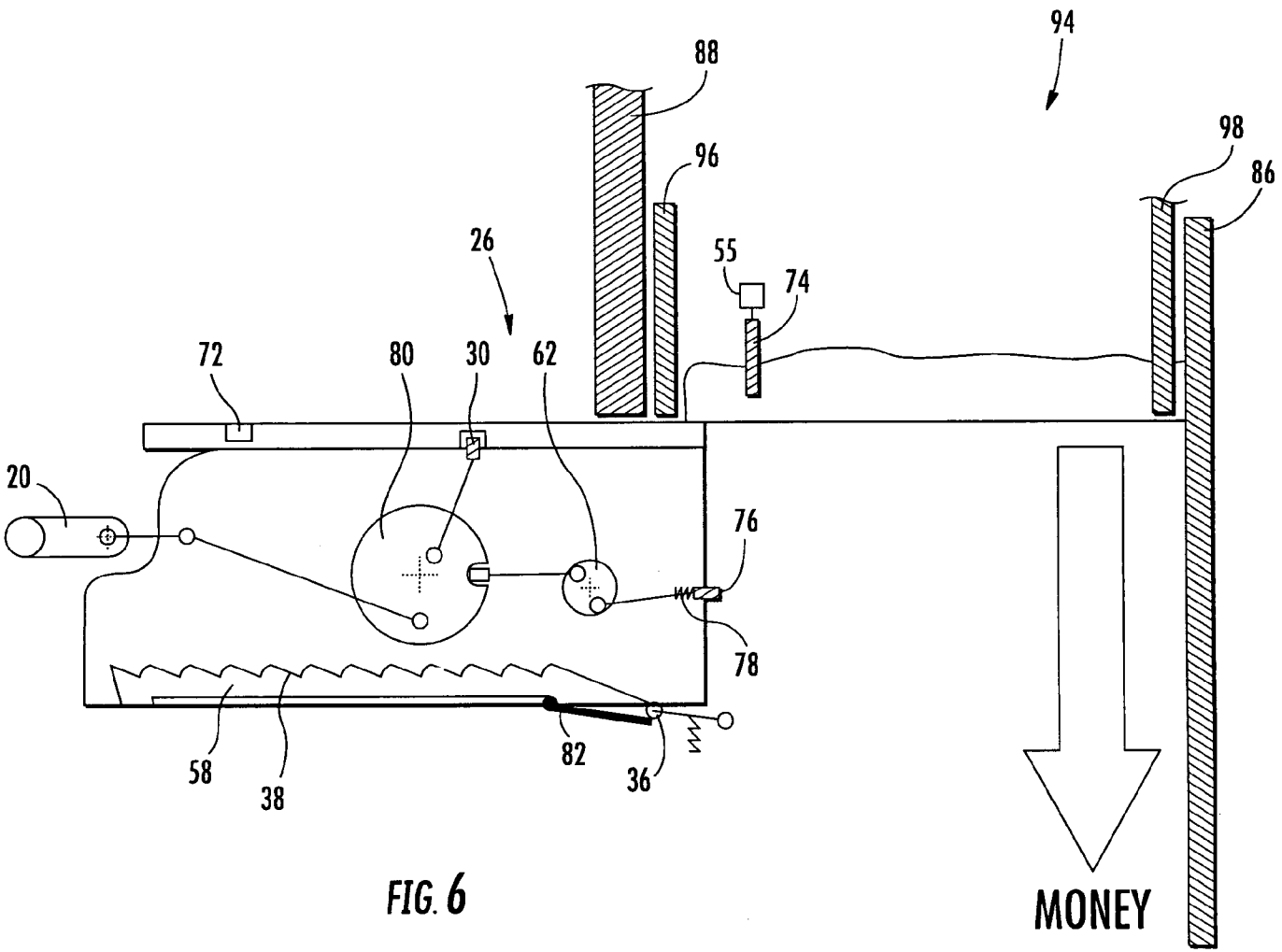
FIG. 6 shows the emptying apparatus shown in FIG. 3 where the wall connected to the slider is shown in the fully opened end position.

FIG. 6 shows the position of the slider 18 shortly before attaining the maximum withdrawn position. The ratchet 38 is configured such that it runs out obliquely at the spring 82 and ends there. When the maximum withdrawn end position of the slider 18 is reached, the blocking lever 36 is thus guided against the spring 82 which in this way forms an opening through which the blocking lever 36 is guided. As soon as the blocking lever 36 has passed this opening, as a result of its pre-tensioning the spring 82 re-closes the opening thus formed. Now the slider 18 can be inserted since the blocking lever 36 can slide along on the lower side of the slider 18.

Figure 7:
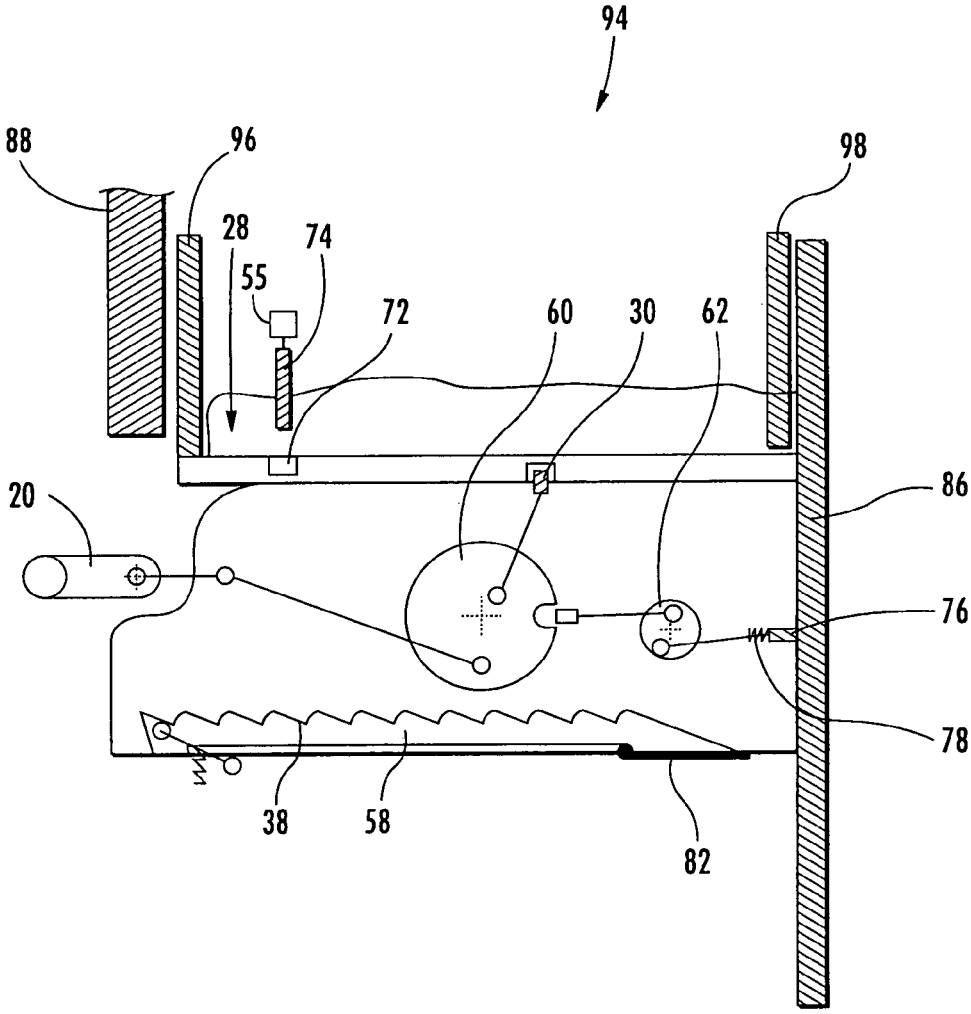
FIG. 7 shows the emptying apparatus in FIG. 3, where the wall connected to the slider is shown in the fully inserted end position.

Sliding the slider 18 into the fully inserted end position 28 has the result that the blocking lever 36 snaps into the opening 58 as a result of its pre-tensioning and again lies on the ratchet 38. On attaining the fully inserted end position 28, the plunger 76 is simultaneously moved against its spring pre-tensioning so that the locking element 80 is simultaneously withdrawn from the notch 84 of the disk 60. Thus, rotatory movement of the disk 60 is released again. The handle 20 can now be pivoted into the folded-in position relative to the casing 12. This movement has the result that the disk 60 is turned clockwise by the rod 66 whereby the locking element 30 is simultaneously guided from the groove 32 of the wall 14 via the rod 64 so that the wall 14 is disconnected from the slider 18 (FIG. 7). The safety bolt 74 is now re-inserted into the groove 72 of the wall 14 by means of the lock not shown in detail so that this is secured against horizontal displacement.

The wall 14 can advantageously have an inclination towards the horizontal in the direction of the casing rear wall 86 in order to facilitate withdrawal under the load of the means of payment located in the cashbox 94. In order to facilitate safe and complete emptying of the cashbox 94, a stripper can also be used to strip means of payment lying on the wall 14. In addition, the slider 18 can also be provided for displacement on an inclined plane. Thus, for example, by means of an inclination in the direction of the casing rear wall 86, it can be achieved that, after attaining the fully withdrawn end position 26, the slider is automatically re-inserted into the fully inserted position 28, for example, by means of a restoring force acting as a result of a weight force.

In addition, however, there can also be provided drives by means of which the corresponding functions are achieved and implemented. Thus, for example, the slider 18 can be driven by a hydraulic, pneumatic or electrical drive which reaches the desired positions via a control system. In a particularly safe refinement, the slider 18, for example, can be remote-controlled. Thus, for example, the slider 18 can be controlled by a control unit which is located at some distance from the fare-box 10. By means of a security interrogation, for example, by entering a code or also by means of a visual check as to whether an authorised person is operating the fare-box 10, clearance can be given for withdrawal of the slider 18.

The examples of embodiment shown in the figures merely serve to explain the invention and are not limiting for the invention. Thus, in particular, the shape of the cashbox, the design of the slidable wall and also the drive mechanisms and the mechanical configuration can vary without losing the spirit of the invention.

The invention claimed is:

1. An apparatus for emptying a storage device for storing of means of payment, the apparatus comprising:

a right-parallelepiped-shaped casing;

the storage device including at least one slidable wall, wherein the casing defines a container for inserting the storage device, so that the storage device is positioned with the slidable wall facing downwards on a slider located in the casing, wherein the slider includes:

a handle, a connecting apparatus for connection with the slidable wall, and a blocking apparatus which allows the slider to be withdrawn from the casing into a withdrawn end position and then pushed in into a fully inserted end position but prevents any pushing in of the slider from any withdrawn position which does not correspond to the withdrawn end position.

2. The apparatus according to claim 1, wherein the handle can be pivoted between a folded-in position relative to the casing and a folded-out position.

3. The apparatus according to claim 2, wherein the handle is formed by a grip.

4. The apparatus according to claim 1, wherein the connecting apparatus comprises at least one locking element which can be inserted in a groove in the slidable wall.

5. The apparatus according to claim 1, wherein the slider has a mechanism by means of which, when the handle is folded out, the connecting apparatus makes a connection between the slider and the slidable wall.

6. The apparatus according to claim 1, wherein the blocking apparatus comprises a blocking member which is guided along a ratchet.

7. The apparatus according to claim 6, wherein the blocking member can be switched between a position which allows insertion of the slider and a position which prevents from insertion.

8. The apparatus according to claim 7, wherein the blocking member can be respectively switched into the inserted and withdrawn end position of the slider.

9. The apparatus according to claim 7, wherein the blocking member is spring-loaded.

10. The apparatus according to claim 7, wherein blocking member is arranged on the casing and the ratchet is located on the slider.

11. The apparatus according to claim 1, wherein the slidable wall is arranged inclined to the horizontal.

12. A cashbox comprising:

a casing including;

a lid having a slot opening for inputting a means of payment;

four side walls; and a bottom wall, wherein at least one of said walls is a slidable wall that is slidable relative to the casing, said slidable wall configured to be slidable such that an opening is formed by displacing said slidable wall, wherein said slidable wall cooperates with a slider located in the casing only be moveable back to a fully inserted end position after attaining a fully withdrawn end position, and wherein said slidable wall is configured to allow said means of payment to be stripped from an interior surface of said slidable wall via an opening movement of said slidable wall that forms said opening, said opening movement ensuring a complete emptying, and said opening configured to allow said stored means of payment to fall into a collecting container positioned under said opening without handling of the cashbox while avoiding that means of payment residue remain on said interior surface of the slidable wall.

13. The cashbox according to claim 12, wherein the slidable wall has at least one groove to accommodate a locking element.

14. The cashbox according to claim 13, wherein the groove is constructed on the outside of the slidable wall and is closed towards the inside of the slidable wall.

15. The cashbox according to claim 12, wherein the cashbox has a safety device for securing the slidable wall against displacement.

16. The cashbox according to claim 15, wherein the safety device is unlockable.

17. The cashbox according to claim 12, further comprising an apparatus for blocking the slot opening against intervention inside the casing and to prevent the return of objects inserted in the casing through the slot opening into a space delimited by the casing located below the slot opening.

* * * * *